US010309063B2

(12) United States Patent
Liu et al.

(10) Patent No.: US 10,309,063 B2
(45) Date of Patent: Jun. 4, 2019

(54) MULTI-STORY CROSSROAD AND ITS TRAFFIC METHOD WITH INTENSIVE LAND USE AND MULTIPLE FUNCTIONS

(71) Applicants: Changshou Liu, Shanghai (CN); Wentao Zhou, Shanghai (CN); Xiang Liu, Shanghai (CN)

(72) Inventors: Changshou Liu, Shanghai (CN); Wentao Zhou, Shanghai (CN); Xiang Liu, Shanghai (CN)

( * ) Notice: Subject to any disclaimer, the term of this patent is extended or adjusted under 35 U.S.C. 154(b) by 71 days.

(21) Appl. No.: 14/852,530

(22) Filed: Sep. 12, 2015

(65) Prior Publication Data

US 2016/0002866 A1 Jan. 7, 2016

Related U.S. Application Data

(63) Continuation-in-part of application No. PCT/CN2014/000160, filed on Feb. 19, 2014.

(30) Foreign Application Priority Data

Mar. 12, 2013 (CN) ..... 2013 1 0078404

(51) Int. Cl.
*E01C 1/04* (2006.01)
*E01C 1/00* (2006.01)

(52) U.S. Cl.
CPC ..... *E01C 1/04* (2013.01); *E01C 1/002* (2013.01)

(58) Field of Classification Search
CPC ..... E01C 1/04; E01C 1/002
(Continued)

(56) References Cited

U.S. PATENT DOCUMENTS 671,686 A * 4/1901 Bergeron ..... E21F 17/103 404/1
1,628,935 A * 5/1927 Turner ..... E01C 1/04 104/124

(Continued)

FOREIGN PATENT DOCUMENTS

CN 1342811 A 3/2002
CN 2644478 Y 9/2004

(Continued)

OTHER PUBLICATIONS

International Search Report dated Apr. 29, 2014.
International Preliminary Report on Patentability dated Feb. 19, 2014.

*Primary Examiner* — Thomas B Will
*Assistant Examiner* — Katherine J Chu
(74) *Attorney, Agent, or Firm* — Symbus Law Group, LLC; Clifford D. Hyra

(57) ABSTRACT

A multifunctional and multi-story crossroad for intensive land use relates to urban road construction engineering and solves technical problems of urban traffic jams through space division and streamlined design, without occupying the land outside the road. It achieves: operating smoothly without red lights, large vehicle-free intersection space on the ground, large parking areas, long "side of the road" border between the parking area and roads, bicycle exclusive system. Technical elements include: learning from building design, multi-story crossroad, "Turning Right and Looping Back technique", "exclusive bikeway interlayer", "adding a lane", and "large steps above ramp of a tunnel." It is a combination of a smoothly flowing crossroad technique, viaduct and the tunnel. The main purposes are: for new construction and renovation of crossroad in congested cities, and development of city fast lanes, elevated roads and tunnels.

5 Claims, 19 Drawing Sheets

(58) Field of Classification Search
USPC ..... 404/1
See application file for complete search history.

(56) References Cited

U.S. PATENT DOCUMENTS

| | | | | |
|---|---|---|---|---|
| 1,661,490 | A * | 3/1928 | Mihaliak | E01C 1/04 104/128 |
| 2,946,267 | A * | 7/1960 | Arturo | E01C 1/04 404/1 |
| 2007/0237576 | A1* | 10/2007 | Peng | E01C 1/04 404/1 |
| 2008/0038054 | A1* | 2/2008 | Gustafson | E01C 1/002 404/1 |
| 2009/0035058 | A1* | 2/2009 | Berman | E01C 1/04 404/1 |
| 2009/0317184 | A1* | 12/2009 | Troster | E01C 1/002 404/1 |
| 2011/0243657 | A1* | 10/2011 | Yeo | E01C 1/04 404/1 |
| 2012/0315084 | A1* | 12/2012 | Makarov | E01C 1/04 404/1 |
| 2015/0043969 | A1* | 2/2015 | Leung | E01C 1/002 404/1 |

FOREIGN PATENT DOCUMENTS

| | | | |
|---|---|---|---|
| CN | 1566530 | A | 1/2005 |
| CN | 1834353 | A | 9/2006 |
| CN | 201695289 | U | 1/2011 |
| CN | 102733279 | A | 10/2012 |
| CN | 103161106 | A | 6/2013 |
| CN | 103321117 | A | 9/2013 |
| JP | 2003082604 | A | 3/2003 |

* cited by examiner

MULTI-STORY CROSSROAD AND ITS TRAFFIC METHOD WITH INTENSIVE LAND USE AND MULTIPLE FUNCTIONS

CROSS-REFERENCE TO RELATED APPLICATIONS

The present application is a continuation-in-part of PCT Application No. PCT/CN2014/000160 filed Feb. 19, 2014, which claims priority to Chinese Application No. 201310078404.8, filed Mar. 12, 2013, which are incorporated herein by reference in their entirety.

TECHNICAL FIELD

The present invention relates to urban road construction engineering, and particularly to a multifunctional and multi-story crossroad for intensive land use and traffic method thereof.

BACKGROUND ART

1. In the 21st century, the city is becoming ever more crowded with more people and more vehicles, the current traffic order mainly based on using mostly the red light system in the intersection has become a shackle of traffic management. A lot of time in our everyday life is wasted while waiting for traffic.

Around the globe, people are looking for a breakthrough in solving this problem.

2. Especially with regard to precious urban land, as there is a huge gap in demand of urban land in the cities. In building crossroads, many urban facilities are removed or relocated. So the need for large scale demolition becomes the bottleneck when building the traditional crossroad in the city center.

In the history of cities, housing has gone through a process from bungalow to high-rise building. With the utilization of the road resource of "usable area" by laminated development, the day of change from flat road to "story way" is coming.

3. There are all kinds of urban transport problems: vehicle parking, temporary parking or parking for a long time are all difficult; curb parking in the road restricts running speed of vehicles; emissions of tail gas are significantly increased by oil burning vehicles braking and starting frequently; Electric vehicles are experiencing problems charging in the road side. Generally, people pay little attention to the traffic system for walking and cycling. Due to the fact that people and vehicles are crossing on the same plane, unexpected accidents have become the norm. Entering and exiting viaduct or tunnel laminated crossroads are quite difficult.

4. The blind spots and disadvantages of the world's currently dominant American cloverleaf Crossroad are as following: wasting land, only considering vehicles, people spending a long time waiting for a green light while walking through the crossing, difficult to walk to the surrounding commercial buildings, and little attention is paid to the needs of bicycles.

CONTENT OF THE INVENTION

An embodiment of the present invention provides a multi-story crossroad, comprising a road by bridge over the intersection, and another road by tunnel through the intersection. In a particular embodiment of the present invention, it is assumed as follows: the North-South road is through the elevated road, the east-west road is through the tunnel. The embodiments differ from case to case. Hence it is also feasible that the north-south road is through the elevated road, and the east-west road is through the tunnel, or vice versa; and it is also possible that the southeast-northwest road is through the elevated road, and the northeast-southwest road is through the tunnel, or vice versa. It depends on the specific conditions of the case. In this description, only one of the cases is chosen, in order to facilitate the expression of the specification and the drawings.

It should be noted that the actual situation differs from case to case. The directions of the two roads of the intersection are not necessarily a positive North-South and a positive east-west, but depend on the specific conditions of the case. In this description, only one of the cases is chosen, in order to facilitate the expression of the solutions and the drawings. Again, the actual situation differs from case to case. The two roads of the intersection are not necessarily orthogonal, and its heterotropic angle varies, depending on the specific conditions of the case. In this description, only one of the cases is chosen, in order to facilitate the expression of the solutions and the drawings.

It should be noted that, in the description of embodiments, it is assumed as follows: the intersection ends of the elevated road, tunnel and bike ramp at the crossroad are 20 meters away from the outer edge of the intersection core—as an example, the two intersectant roads are bidirectional with 5 lanes, and the motorway is 35 meters wide, and the total width is 41 meters when the bikeway is included. The term "intersection core" refers to an area of 41×41 square meters, and after expansion of 20 meters on all sides respectively, the resulting area of 41×41+41×20×4 square meters is named the "Extended Area of the Intersection Core";

The present invention provides multifunctional and multi-story crossroads for intensive land use, with story segregation in the area of road junctions and nearby sections, specifically including four layers of elevated road layer (100), interlayer (200), ground floor (300) and tunnel layer (400) from top to bottom;

Wherein the elevated road layer (100) is configured for vehicles traveling straight along the north-south direction when they need to pass straight at the crossroad; it is also used for vehicles turning right and traveling down to the ground floor (300) when they need to turn right; it is also used for vehicles turning right first, then going straight, then turning around, and then traveling down to the ground floor (300) when they need to turn left;

The interlayer (200) is configured for bicycles exclusively; Part of the intersection of the ground floor (300) is configured for a vehicle-free community center;

The tunnel layer (400) is used for vehicles traveling along the east-west straight when they need to pass straight at the crossroad; it is also used for vehicles turning right and traveling up and along the ground floor (300) when they need to turn right; it is also used for vehicles turning right first, then going straight, then turning around, and then traveling up to the ground floor (300) when they need to turn left;

It should be noted that within the scope of the Extended Area of the Intersection Core, all four floors are planes, the ramp (or the ramp hole) starts from or ends with the edge of the Extended Area of the Intersection Core.

Preferably, the road by which the vehicle passes through the crossroad via elevated road is named the "elevated road", and is assumed to be a north-south road in the specification. Another road by which the vehicle passes through the crossroad via a tunnel is named the "tunnel road", and is assumed to be an east-west road in the specification.

The elevated road layer (100) includes straight bridges across the crossroad, and a horizontal elevated platform with long-wings in both sides. The said straight bridge lies in and extends along the north-south direction, and the horizontal elevated platform with long-wings in both sides, lies in and extends along the east-west direction. In addition, the straight bridge and the horizontal elevated platform with long-wings in both sides are meeting with each other at the intersection (It should be noted that the combination of straight bridge and horizontal elevated platform with long-wings in both sides is named the "elevated road layer.")

The straight bridge of the elevated road layer specifically includes elevated road main ramp (32) along the North-South direction, and horizontal right-turn lane (60) located in the Extended Area of the Intersection Core on the right side of each elevated road main ramp (32).

The horizontal elevated platform with long-wings in both sides of the elevated road layer specifically includes two horizontal long wings with the direction of east-west. The horizontal long wing of each elevated road layer comprises a parking area (44) beside the motorway of the elevated road layer in the middle of the horizontal long-wing, vehicle straight-going lane (61) located on the right side of the horizontal long-wing, left-turn vehicle looping-back lane (46) of the elevated road layer at the end of horizontal long-wing, downward ramp (28) for right-turn vehicles in the elevated road layer returning to the ground floor, the said ramp (28) is located on the right side of the horizontal long-wing and connected downward to the ground floor, and downward ramp (29) for left-turn vehicles in the elevated road layer returning to the ground floor, the said ramp (29) is located on the left side of the horizontal long-wing and connected downward to the ground floor.

In the structure of the elevated road layer:

Flow line (1) of vehicles going straight on elevated road layer: two elevated road main ramps (32), which are in north-south direction, constitute a continuous road for vehicles passing straight;

Flow line (2) of vehicles turning right on elevated road layer: horizontal right-turn lane (60) located in the Extended Area of the Intersection Core on the straight bridge, and downward ramp (28) for right-turn vehicles in the elevated road layer returning to the ground floor, constitute a continuous road for vehicles turning right;

Flow line (3) of vehicles turning left on elevated road layer: The U-type successive connection of horizontal right-turn lane (60) located in the Extended Area of the Intersection Core on the straight bridge, vehicle straight-going lane (61) on horizontal long wing, left-turn vehicle looping-back lane (46) on elevated road layer, and downward ramp (29) for left-turn vehicle in the elevated road layer returning to the ground floor, constitute a continuous road for vehicles turning left;

Preferably, the tunnel road for vehicles passing through the crossroad is called the "tunnel road", which in the specification is assumed to be in the direction of east-west.

The tunnel layer (400) comprises a straight tunnel through the intersection, and horizontal tunnel of long wings in both sides; the straight tunnel lays in and extends along the east-west direction, and the horizontal tunnel of long wings in both sides lays in and extends along the north-south direction, the straight tunnel through the intersection and the horizontal tunnel of long wings in both sides meet with each other at the intersection (It should be noted that the combination of the straight tunnel and the tunnel in both wings, is called the "tunnel layer").

The straight tunnel of the tunnel layer specifically includes two-way main tunnel ramp (16) of east-west, and horizontal right-turn lane (60) of Extended Area of the Intersection Core which is located at the right side of each main tunnel ramp (16).

The horizontal tunnel of long wings, in both sides of the tunnel layer, specifically includes two horizontal two-way long wings in the east-west direction. The horizontal long wing of each tunnel layer comprises parking area (21) beside the lanes of the tunnel layer in the middle of the horizontal long-wing, vehicle straight-going lane (61) located on the right side of the horizontal long-wing, left-turn vehicle looping-back lane (23) of the tunnel layer at the end of horizontal long-wing, upward ramp (17) for right-turn vehicles in the tunnel layer returning to the ground floor which is located on the right side of the horizontal long-wing and connecting upward to the ground floor, and upward ramp (18) for left-turn vehicles in the tunnel layer returning to the ground floor which is located on the left side of the horizontal long-wing and connecting upward to the ground floor.

In the structure of the tunnel layer:

Flow line (7) of vehicles going straight on tunnel layer: two two-way tunnel main ramps (16), which are in the north-south direction, constitute a continuous road for vehicles passing straight;

Flow line (8) of vehicles turning right on tunnel layer: horizontal right-turn lane (60) located in the Extended Area of the Intersection Core on the bottom of the straight tunnel, and upward ramp (17) for right-turn vehicles in the tunnel layer returning to the ground floor, constitute a continuous road for vehicles turning right;

Flow line of vehicles turning left on tunnel layer (9): The U-type successive connection of horizontal right-turn lane (60) located in the Extended Area of the Intersection Core on the bottom of the straight tunnel, vehicle straight-going lane on horizontal long wing (61), left-turn vehicle looping-back lane (23) on tunnel layer, and upward ramp (18) for left-turn vehicles in the tunnel layer returning to the ground floor, constitutes a continuous road for vehicles turning left;

Preferably, part of the intersection on the ground floor is configured for a vehicle-free community center. It includes: A, the higher part under the two main ramps of the elevated road; and B, an extended area in the space of Intersection Core; and C, two sets of stairs (37) oppositely arranged above the two main ramps of the tunnel.

It should be noted that the aforesaid vehicle-free community center in the above crossroad is truly vehicle free. There is no access route to the community center for vehicles.

Preferably, "sets of stairs above ramp of a tunnel": As shown in FIG. 7, the "tunnel main ramp" (16) produces two large holes in the ground. Two sets of stairs are built above the holes, of which the depth is tentatively 10 m, and the height is tentatively 0.5 m. The number of stairs would be not less than 5 and not more than 8. The slope of the stairs is basically parallel with that of the tunnel main ramps, as shown in (37) of FIG. 7.

Preferably, the exclusive bikeway interlayer (38) is located in the range of the Extended Area of the Intersection Core, sandwiched between the ground floor and the top of the elevated road. Openings are made in the center of the exclusive bikeway interlayer, where the bike ramps (34) are arranged and connected with the ground urban transport network of the ground floor.

The exclusive bikeway interlayer (38) has three features: A. The exclusive platform; B. The interlayer is 4 or 5 times wider than the bikeway on the ground, in order to lower the traffic density; C. The distance between the entrance and the exit of the interlayer is designed to be long, in case of a traffic jam.

Another embodiment of the present invention provides a multifunctional and multi-story crossroad traffic method for intensive land use (in the way of vehicle flow line):

Going straight;

For vehicles on the elevated road layer, cars drive in a straight line along the straight bridge of the elevated road layer (100) in the north-south direction;

For vehicles on the tunnel layer, cars drive in a straight line along the straight tunnel of the tunnel layer (400) in the east-west direction;

Turning right;

For vehicles on the elevated road layer, cars turn right at the Extended Area of the Intersection Core of elevated road layer (100), go through the downward ramp (28) for right-turn vehicles in the elevated road layer returning to the ground floor, and then travel down into the ground floor (300), then into the ground urban transport network;

For vehicles on the tunnel layer, cars turn right at the Extended Area of the Intersection Core of tunnel layer (400), go through the upward ramp (17) for right-turn vehicles in the tunnel layer returning to the ground floor, and then travel up into the ground floor (300), then into the ground urban transport network;

Turning left;

For vehicles on the elevated road layer, first, cars turn right at the Extended Area of the Intersection Core of elevated road layer (100), and then go through horizontal long-wings of the elevated road layer. The cars subsequently go straight along vehicle straight-going lane (61) of horizontal long-wings and then turn back along the left-turn vehicle looping-back lane (46) of the elevated road layer at the horizontal long-wing. As they are adjusted to an appropriate direction, they pass down into the ground floor (300) along the downward ramp (29) for left-turn vehicles in the elevated road layer returning to the ground floor, and then come to tunnel main ramp (16), back to the crossroad core.

For vehicles on the tunnel layer, firstly, cars turn right at the Extended Area of the Intersection Core of tunnel layer (400), and then go through horizontal long-wings of the tunnel layer. The cars subsequently go straight along vehicle straight-going lane (61) of horizontal long-wings and then turn back along the left-turn vehicle looping-back lane (23) of the tunnel layer at the horizontal long-wing. When they are adjusted to an appropriate direction, they pass up into the ground floor (300) along the upward ramp (18) for left-turn vehicles in the tunnel layer returning to the ground floor, and then come to elevated road main ramp (32), back to the crossroad core.

Preferably, an embodiment of the present invention offers different unimpeded traffic flow lines for three kinds of traveling vehicle (no traffic lights or other traffic control are required);

1. For straight going vehicles: they can go along the straight lane without any impediment;

2. For vehicles turning right: they can directly turn right;

3. For vehicles turning left: a "Technique of Turning Right and Looping Back" or "Technique of Running Vehicle to Take Space" is adopted, which means that vehicle would turn right firstly to the horizontal long-wing when they need to turn left, and then drive straight along the vehicle straight-going lane (61) on the horizontal long-wing, and then turn around to a straight-going lane, returning back to the ground floor (i.e. turning left=turning right+going straight+turning around). Wherein the two movements of going straight and turning around are completed on the horizontal long-wing in both sides. When the vehicles are adjusted to an appropriate direction, they drive a distance of two stories to the cross-road core.

The ground floor (300) is sandwiched between the elevated road layer (100) and the tunnel layer (400). The ground floor (300) lies between, as a good connecting solution to connect the tunnel layer (400) and the elevated road layer (100) when cars turn left. Therefore, the tunnel layer (400), the ground floor (300), and the elevated road layer (100) achieve a combination of the three layers in an orderly manner. The four vehicle left turn lanes are independent and exclusive, interluding from high to low, weaving a left turn network of three layers and four left turn ring, which can maximize the smoothness, simplification, metrical and geometric rhythm of traffic lines.

It should be noted that generally the left turn vehicles are only about 20 percent of the total traffic traveling in a single direction. For example, when the two intersectant roads are two way five-lanes, the vehicles turning right and looping back only take one lane of traffic. Hence if the long-wings have a width of ten lanes, and only one lane is for left turn vehicles, a large proportion of the long wing area can be used for parking. All of these require only that the left turn vehicle should loop back. As a result, the crossroad can not only operate smoothly without red light control, but can also provide a large precious proportion of area for parking. The parking area (21) beside the lanes of the tunnel layer and the parking area (44) beside the lanes of the elevated road layer are level with the road, and are rectangular, which is a rare advantage As the border line of the road and parking area is nearly 2000 meters long, it is particularly suitable for arranging parking spaces with public charging posts for electric vehicles.

Preferably, the method of "Adding a Lane" is used. A ramp way is added above the upward ramp (18) for left-turn vehicles in the tunnel layer returning to the ground floor, the said ramp way is parallel with the upward ramp (18) for turning vehicles in the elevated road. When it reaches the top elevation of the elevated road, it turns right to take the area above the bikeway (5) and (43) until reaching the intersection, to reduce the car flow of the main ramp. Hence it leaves the main ramp to the cars going straight by adding a lane for the cars turning (See FIG. 27). It also creates a lane for cars to turn round (See FIG. 26), as an additional benefit. The ramp way is U-shaped (see 12 and 27 of FIG. 26 and 6 and 42 of FIG. 27). It would also provide areas for a second round of development (See 22 of FIG. 26 and 41 of FIG. 27).

It is optional to meet the need without excessive construction.

It should be noted, the embodiment of the present invention provides a multifunctional and multi-story crossroad for Intensive land use and traffic method thereof, also having many technical effects as follows:

The crossroad uses the characteristics of multi-story houses for reference. First, the surface of multi-stories, the space of all the stories make the best use of the space of the road, and all the projections are controlled to be within the range of the road, without occupying the land outside the road;

Second, in addition to the necessary ramp, all the layers are designed to be horizontal to guarantee the usable area. Areas with no car flow are "flat", which is very valuable;

Third, it uses the characteristic of large sets of stairs, which utilize flexibly the space division and circulation design in architecture.

"The Combination of a Viaduct or a Tunnel": This method is combined with a viaduct or tunnel by making a viaduct or a tunnel as one motorway story, or by adding two or three stories to a viaduct or a tunnel to make it an adaptation of this invention.

"Supporting Small Intersection" is one of the adaptations of this invention. To support this crossroad, the crossroads on the road should be upgraded. And a supporting small intersection is recommended. It should be designed as the neighboring intersections of the multi-story crossroad. The supporting small crossroad comprises two stories, one of which is motorway, and another is a bikeway and sidewalk. The features are: A. The plane level crossing of sidewalk and bikeway; B. the vehicles on the main lane are prohibited from turning left; C. the vehicles on the minor lane in the side directions are prohibited from going straight or turning left.

The Seven Highlights New Era of Multi-Story Road Milestones

1) Unblocked Traffic Flow Without Traffic Light and Crossing Independent Lanes

2) Exclusive Bikeway Interlayer Sufficient Parking Space for Bikes

3) The Intersection Space Community center Public Courtyard of Surrounding Buildings Shared Courtyard As Large as Two Football Fields If the Road is Wide Enough 4) Large Parking Area 40000 $m^2$ of Area If the Road is Wide Enough 5) Intensive Land Use More than 2 of Plot Ratio Without occupying the land outside the road, it solves the problems of: (1) Traffic jams; (2) Parking vehicles; (3) Urban space; (4) Passages of surrounding buildings; (5) Charging posts for electric vehicles, and so on.

6) Environment-friendly Single Crossroad Sides of the Road Nearly 2000 meters Long Enough to Accommodate Hundreds of Public Charging Posts Close to the roadside.

7) Method of Turning Right and Looping Back Three-story-and-four-ring Left Turning Network Other Characteristics:

Lamination Parallel Floors Horizontal Long Wings in Four Directions Large Steps

BRIEF DESCRIPTION OF DRAWINGS

1. Perspective Views of the Present Invention.

2. Plan Diagrams and Cross-Sectional Diagrams of the Present Invention.

Figure 1:
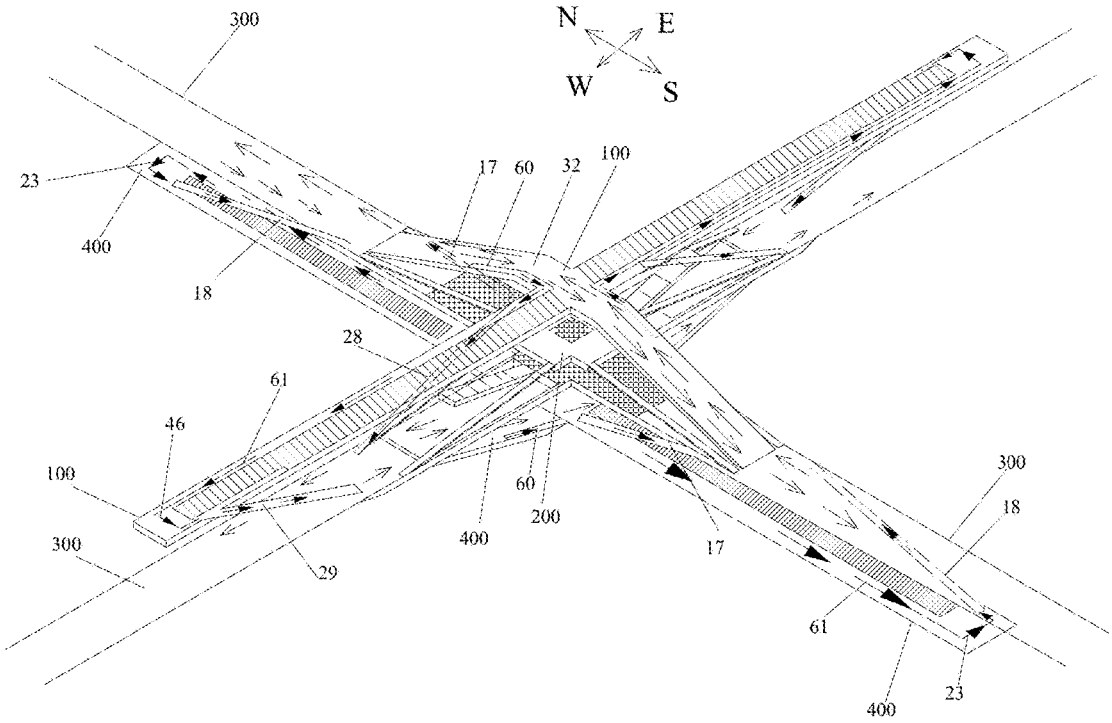
FIG. 1 is a structural schematic diagram of a multifunctional and multi-story crossroad for intensive land use according to an embodiment of the present invention
Figure 2:
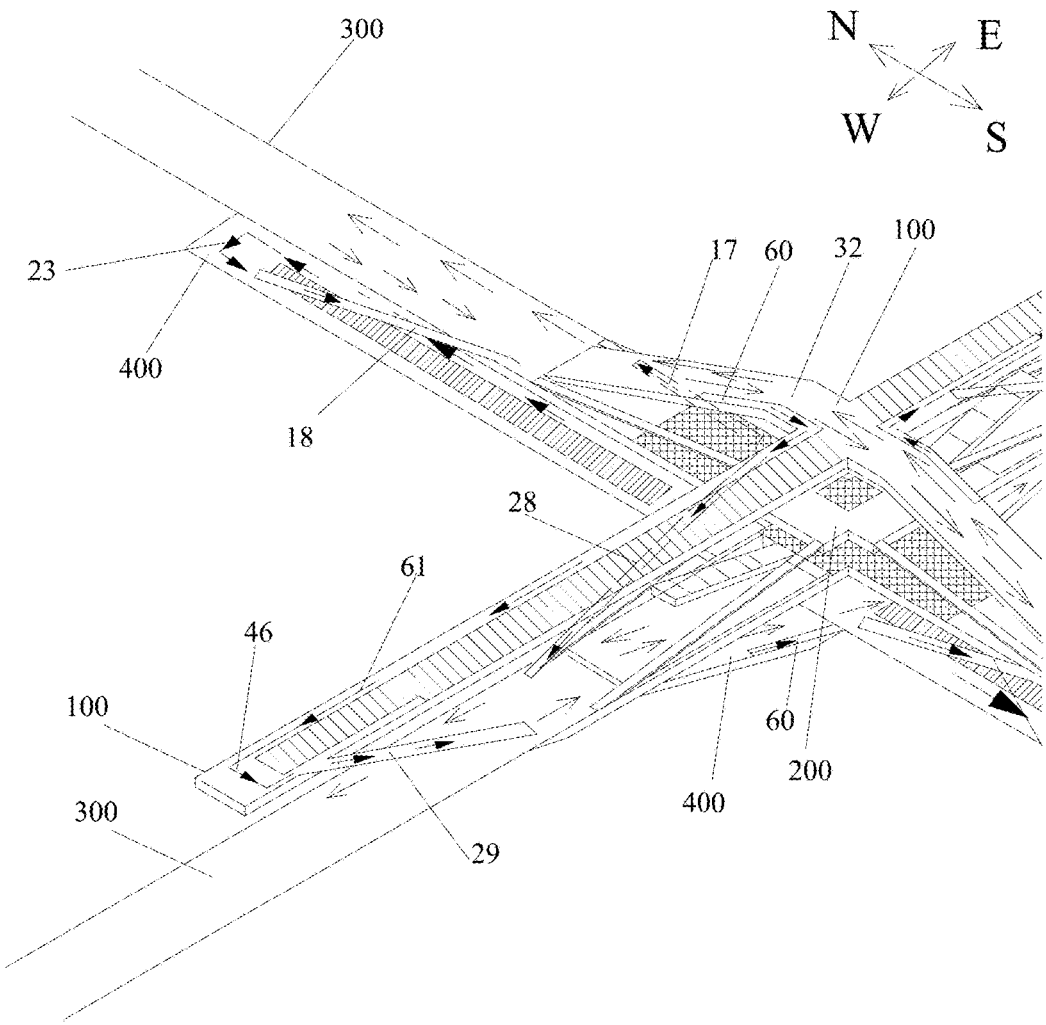
FIG. 2 is an enlarged part of structural schematic diagram of a multifunctional and multi-story crossroad for intensive land use according to an embodiment of the present invention.
Figure 3:
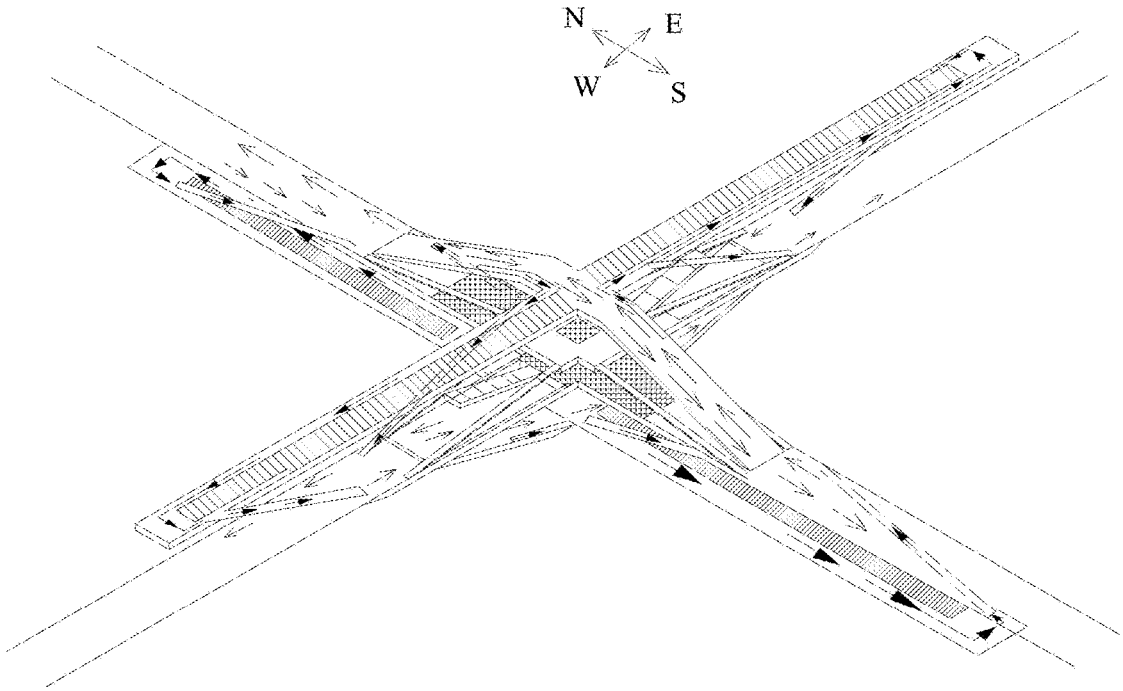
FIG. 3 is a schematic diagram of traffic Flow Line of a multifunctional and multi-story crossroad for intensive land use according to an embodiment of the present invention.
Figure 4:
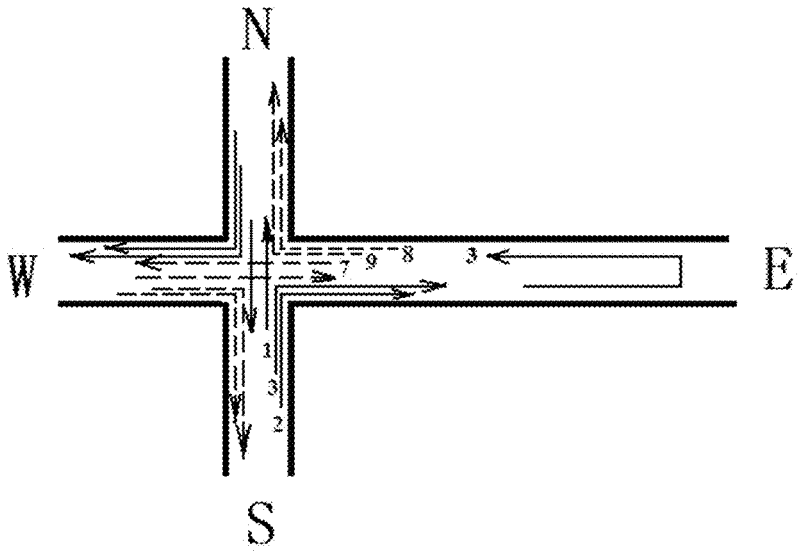

FIG. 4 Diagram of Turning Right and Looping Back

Figure 5:
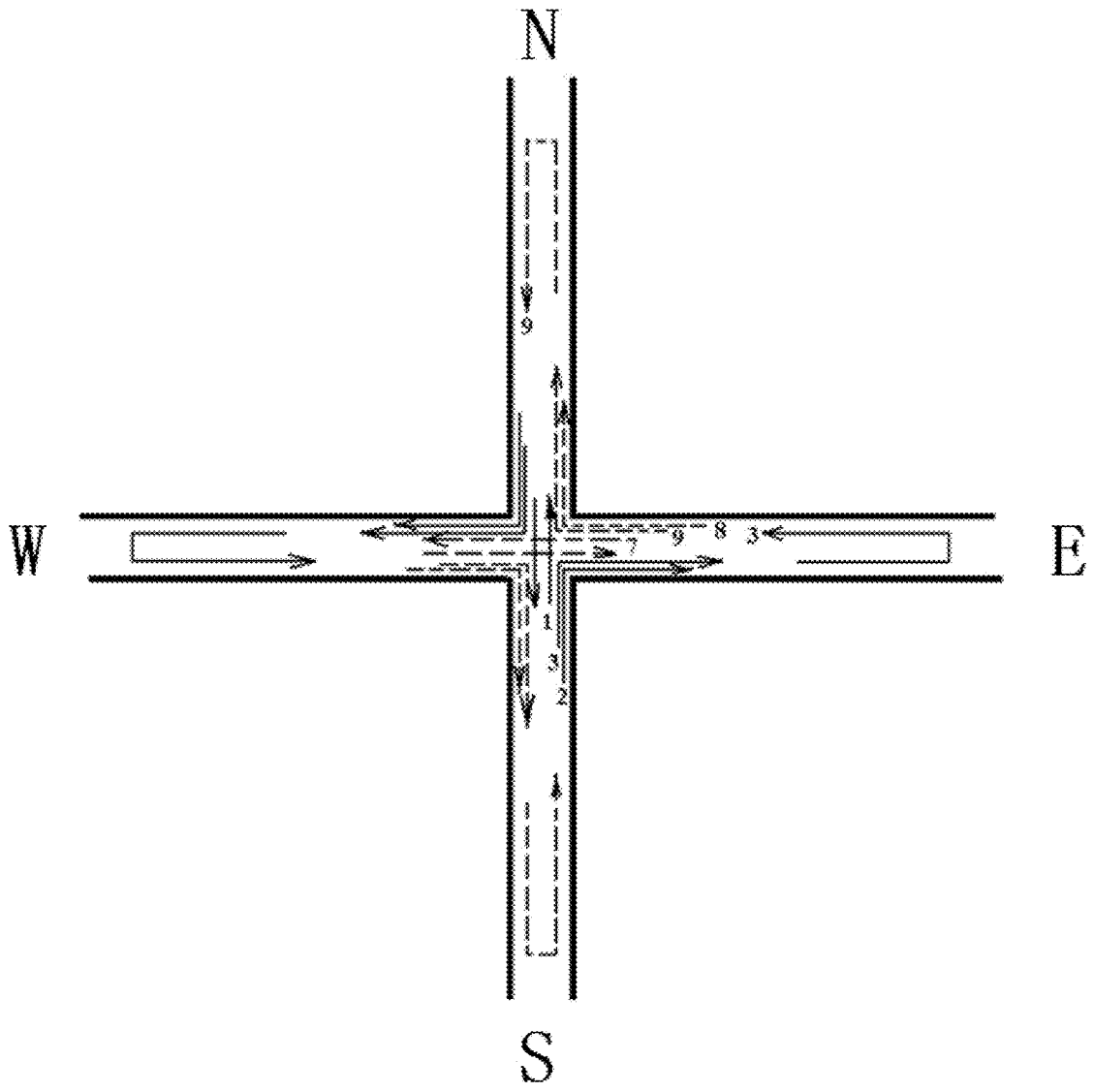
Figure 6:
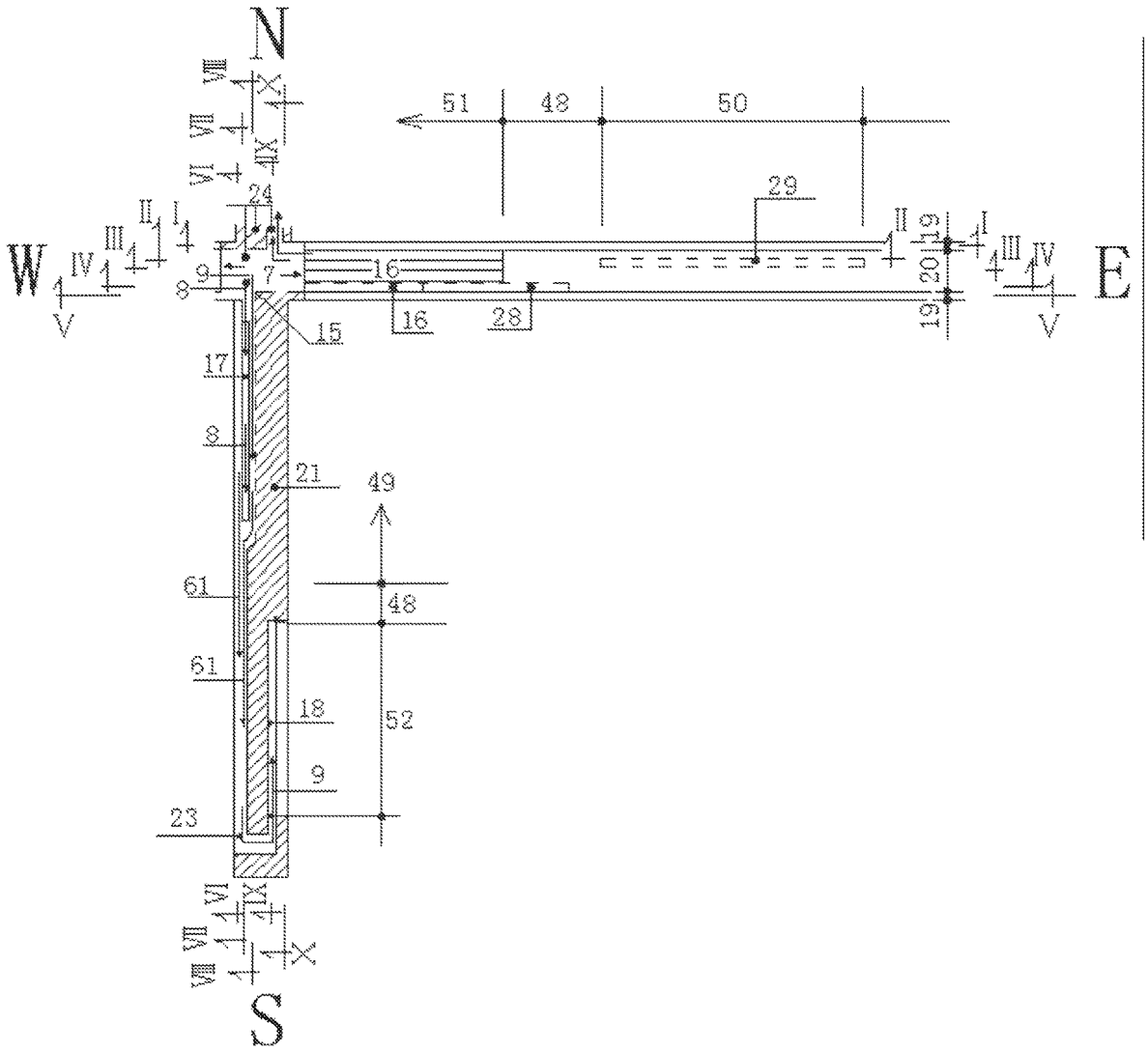
Figure 7:
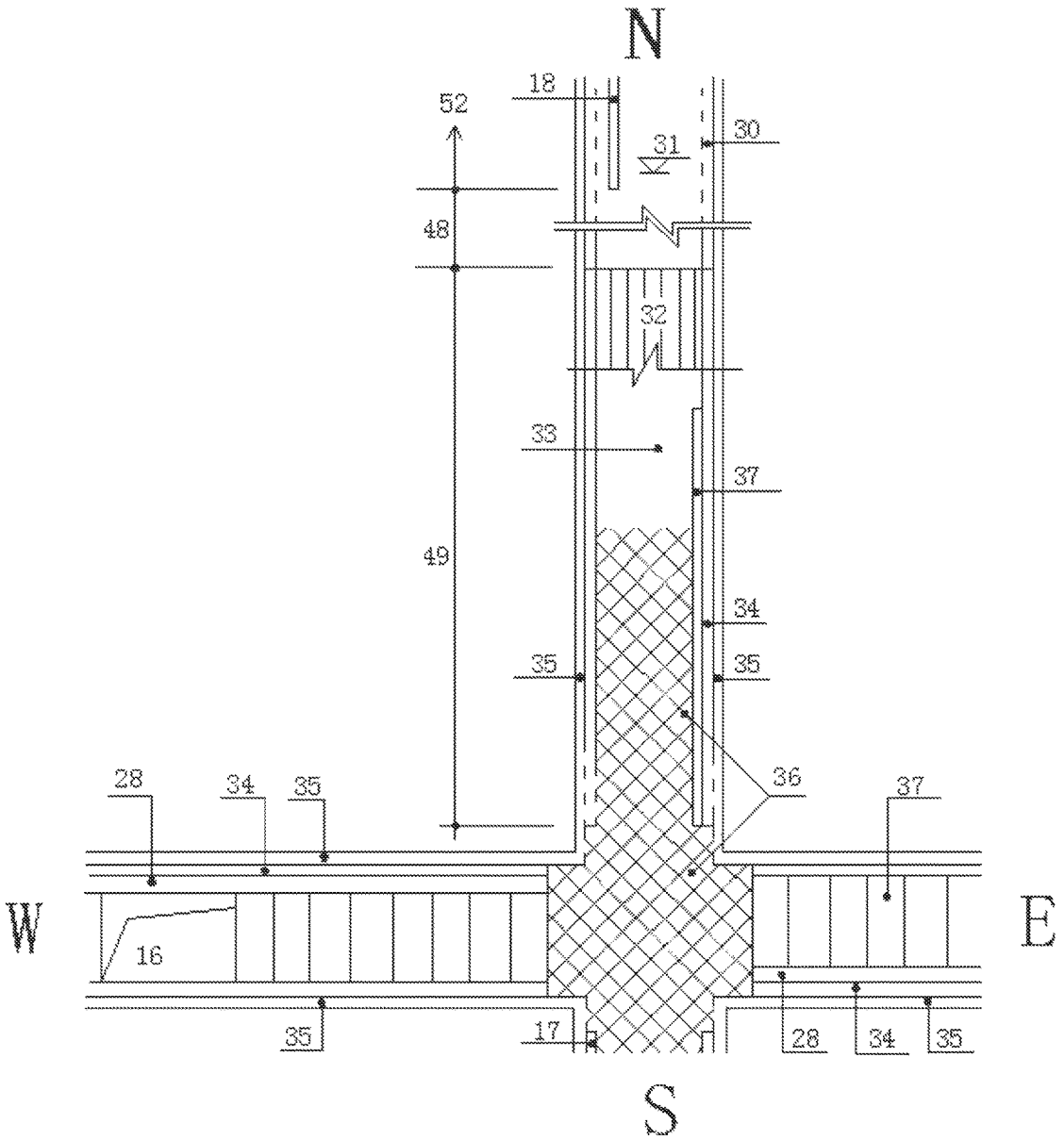
Figure 8:
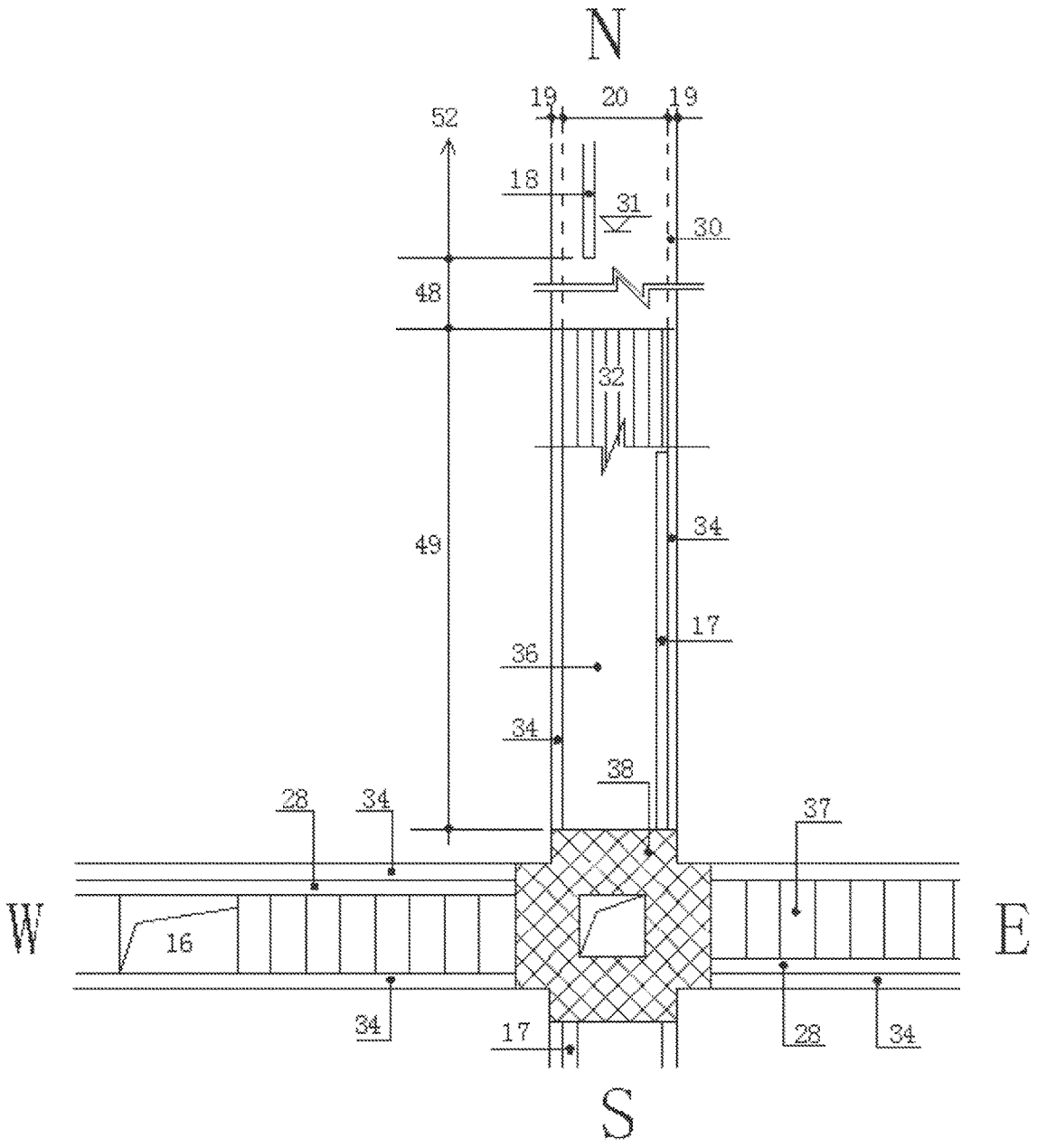
Figure 9:
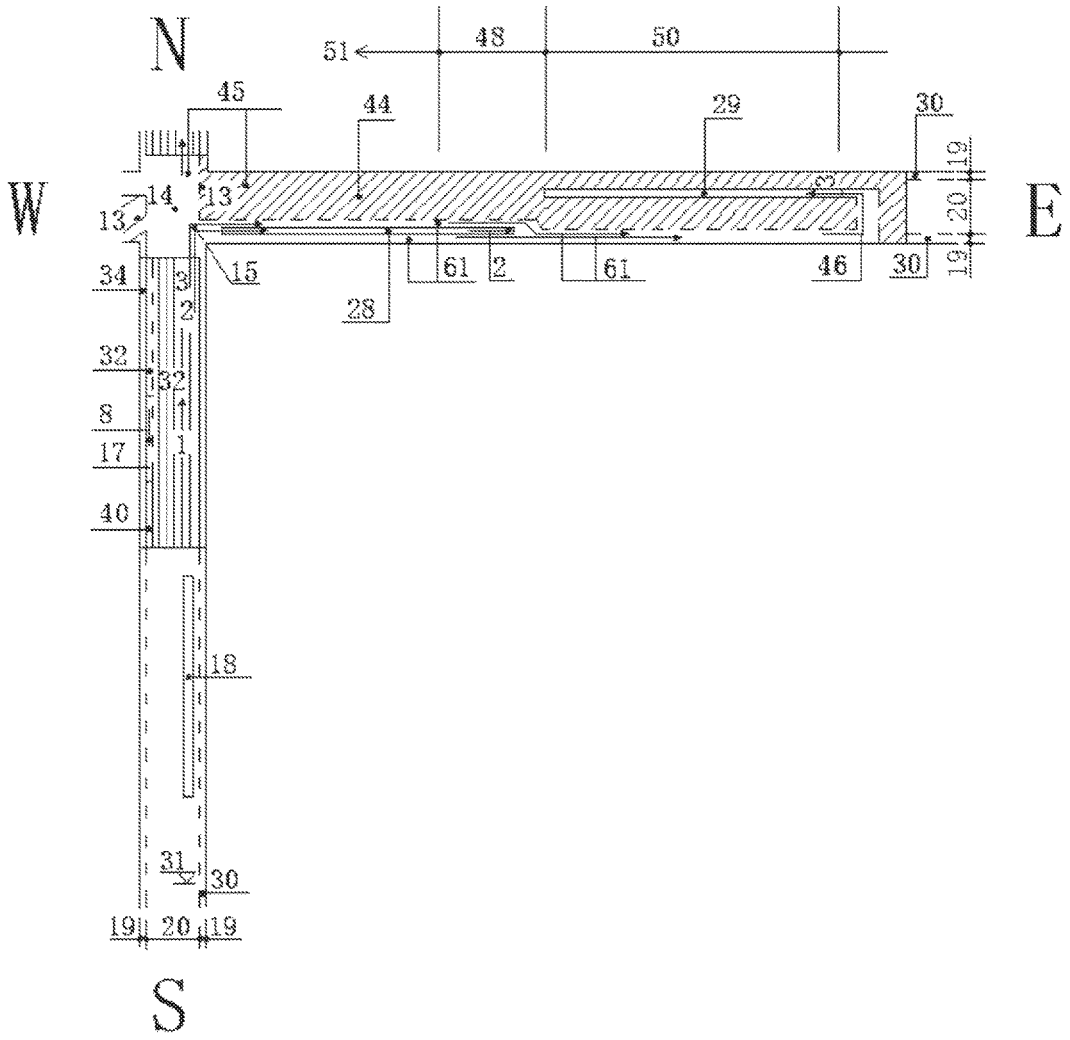
Figure 10:
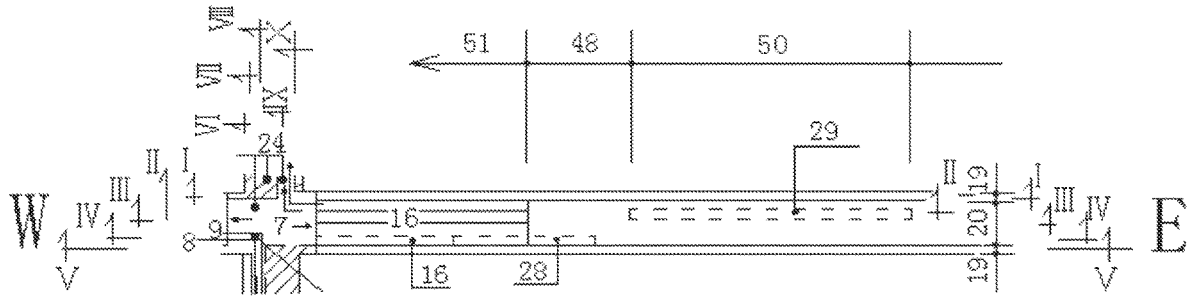
Figure 10:
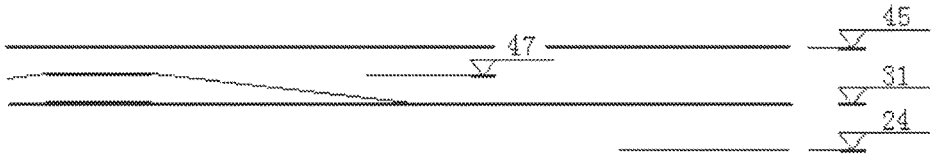
Figure 11:
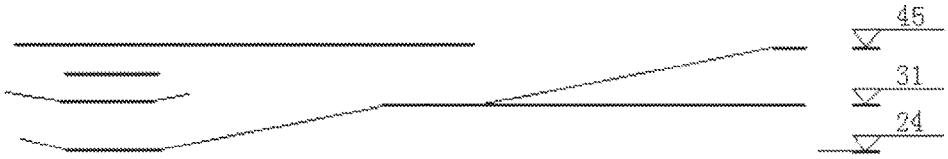
Figure 12:
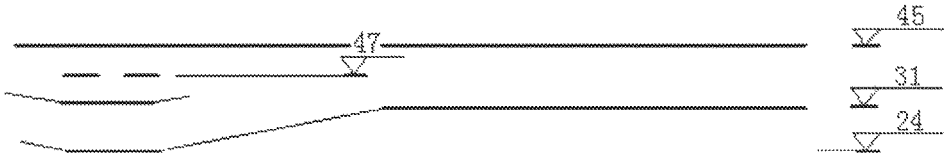
Figure 13:
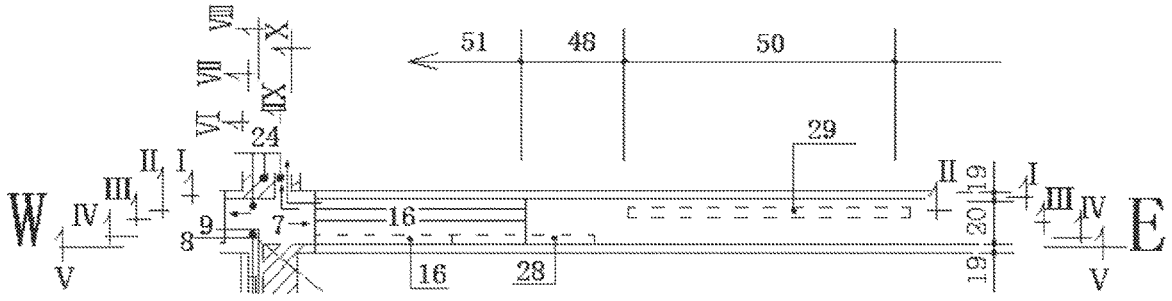
Figure 13:
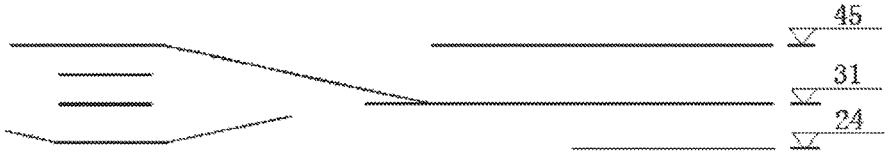
Figure 14:
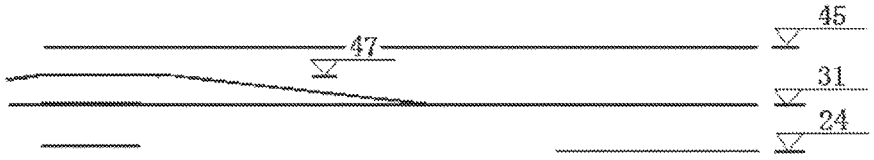
Figure 15:
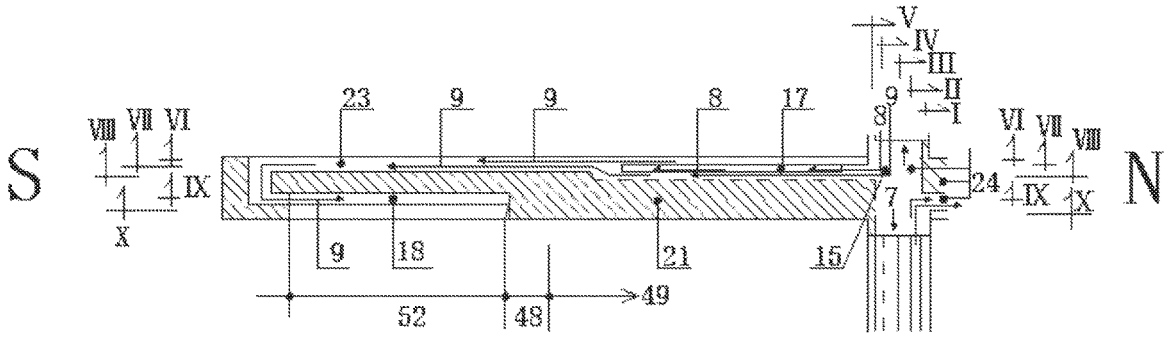
Figure 15:
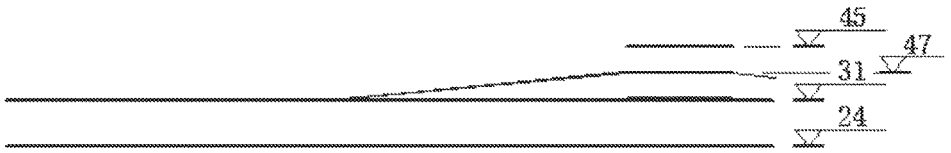
Figure 16:
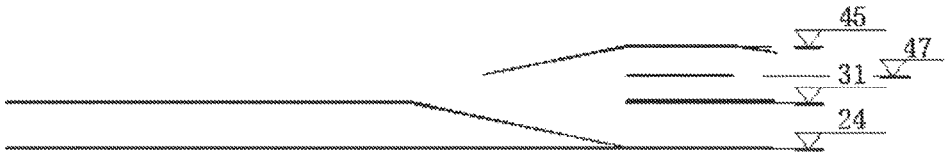
Figure 17:
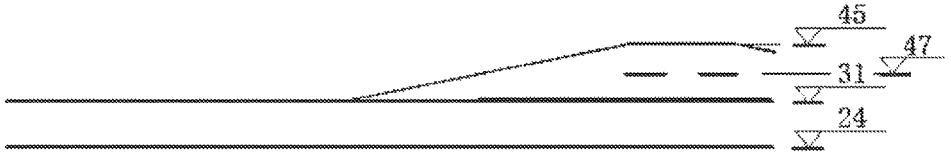
Figure 18:
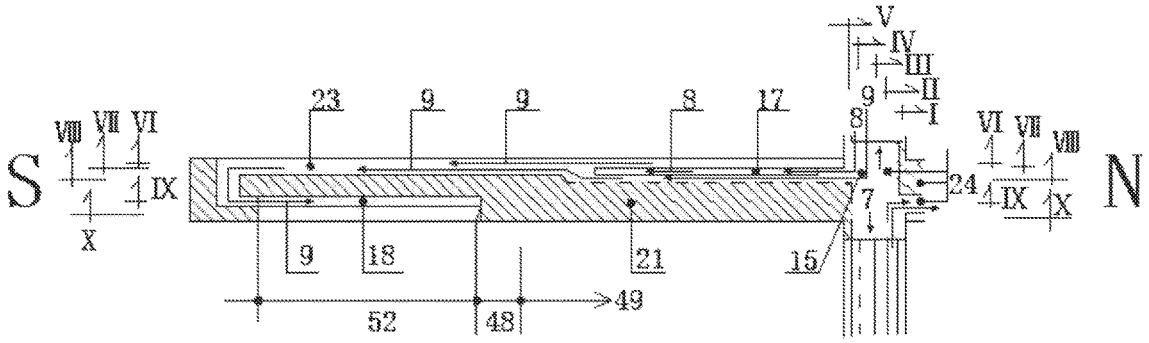
Figure 18:
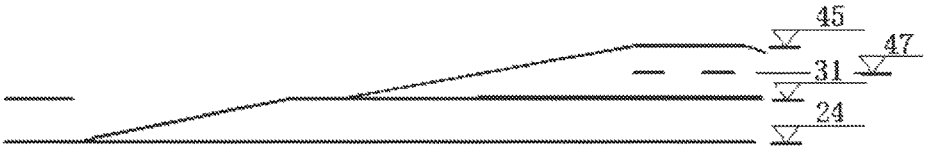
Figure 19:
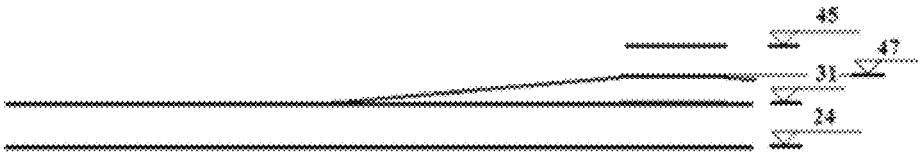
Figure 20:
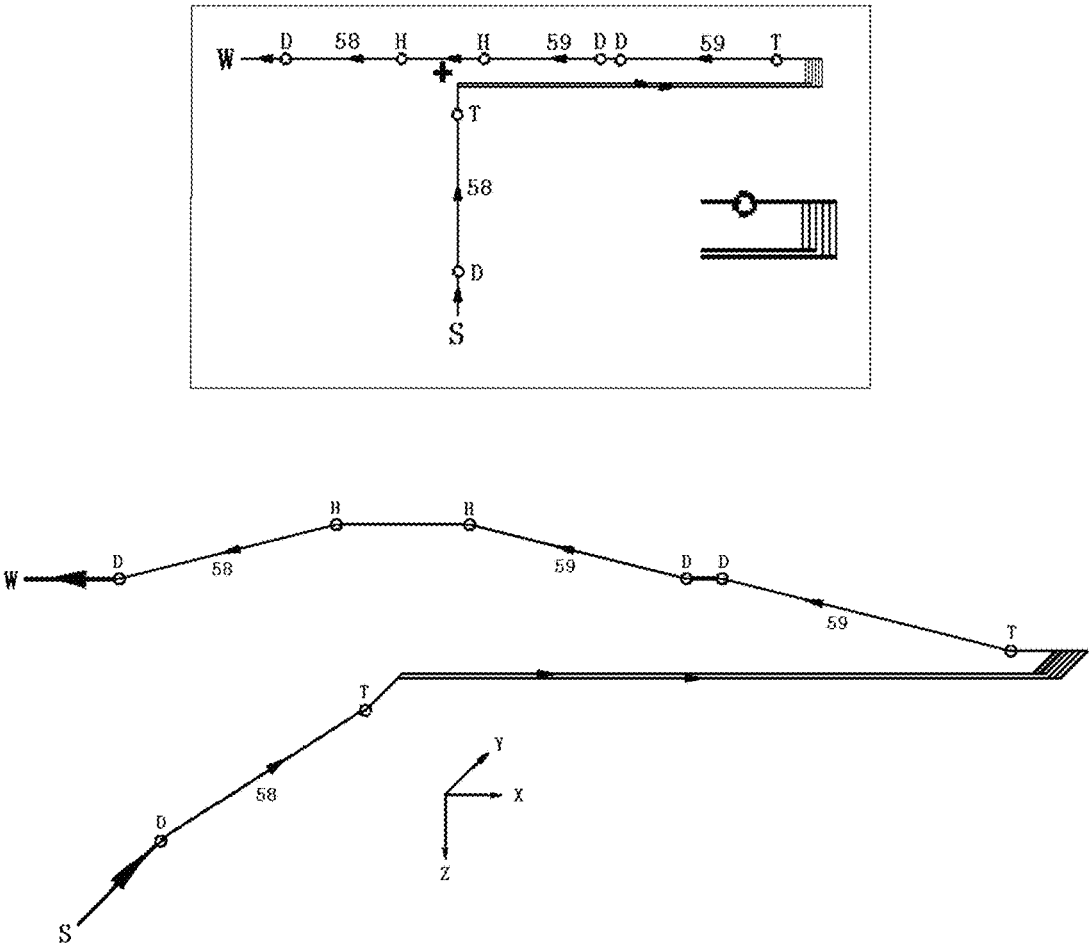
Figure 21:
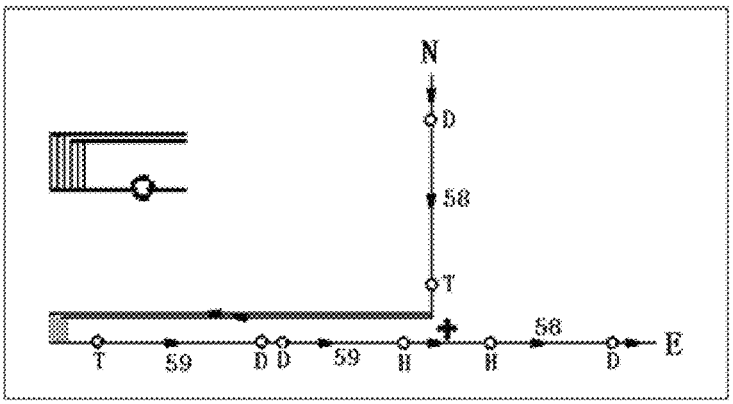
Figure 21:
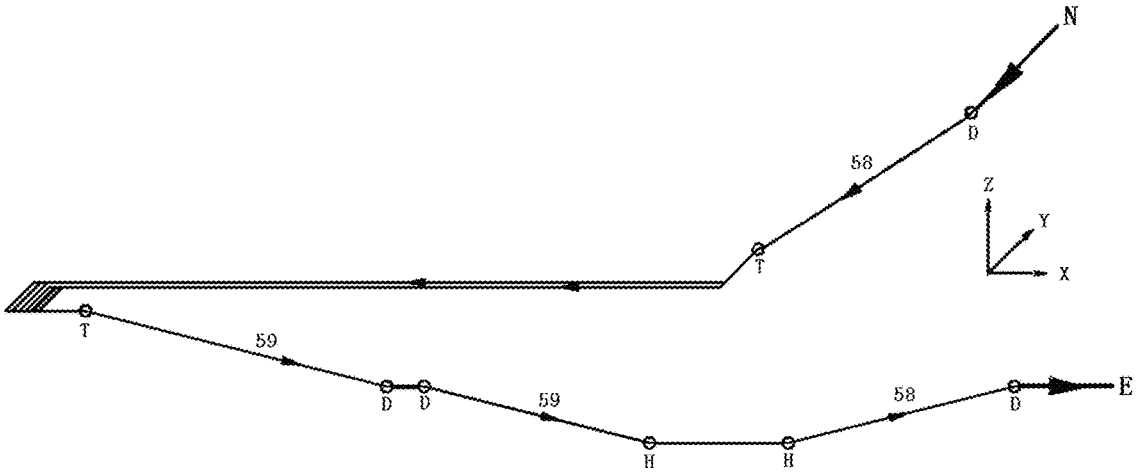
Figure 22:
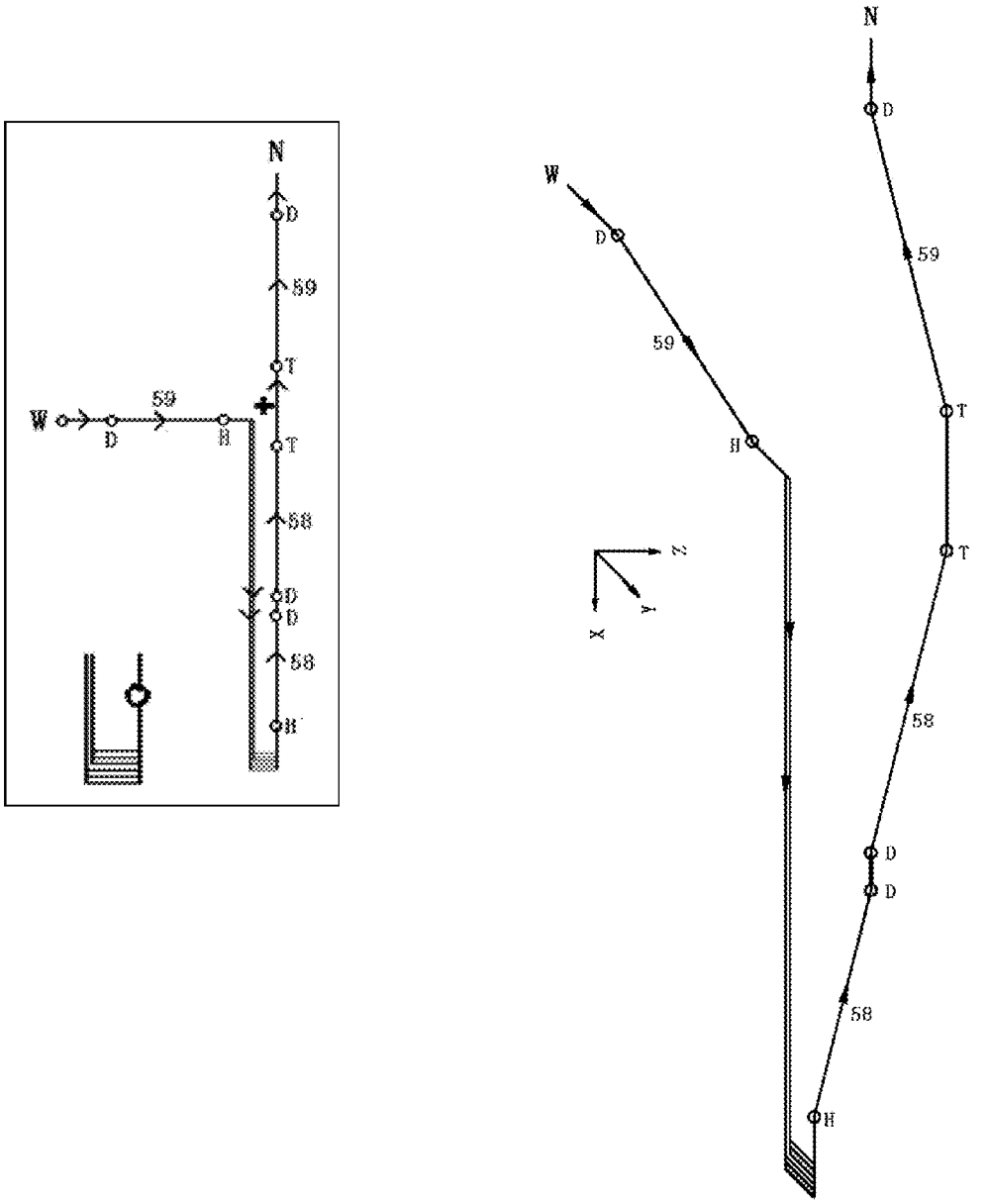
Figure 23:
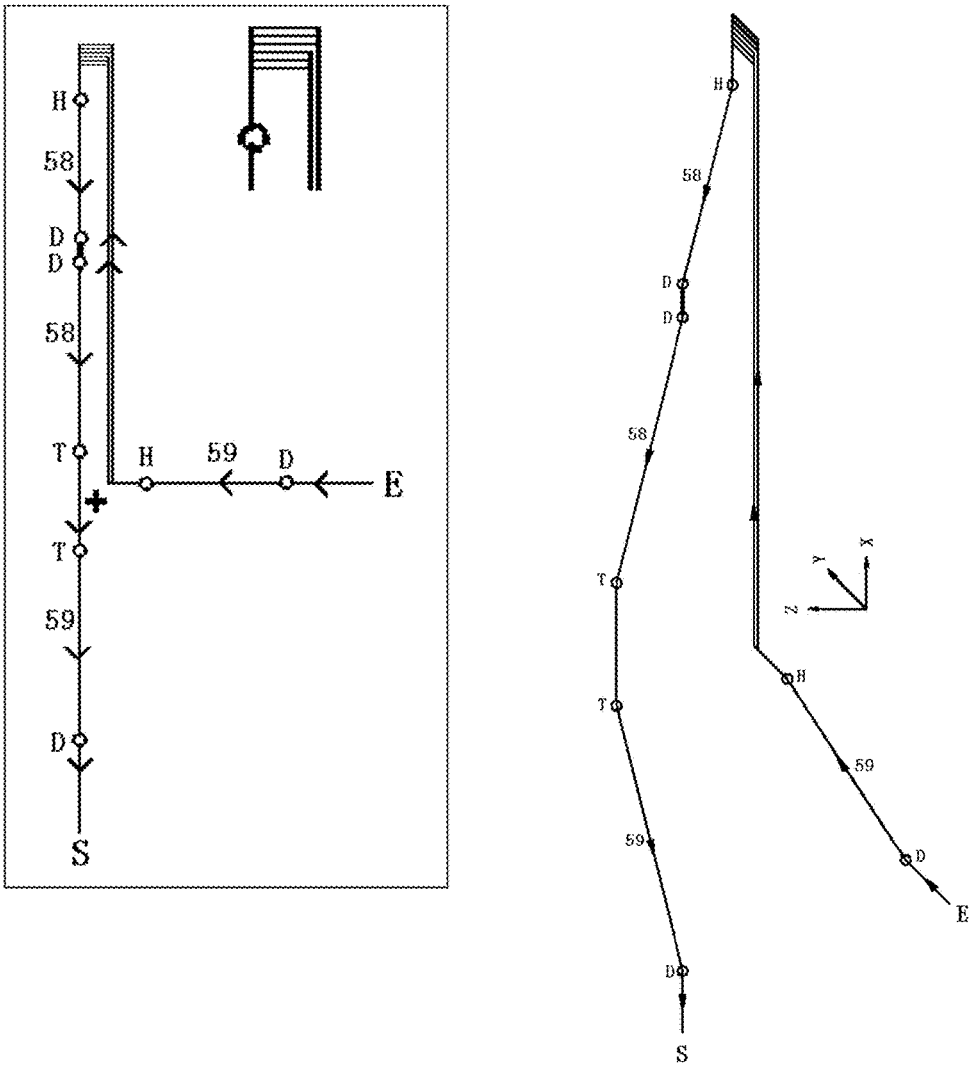
Figure 24:
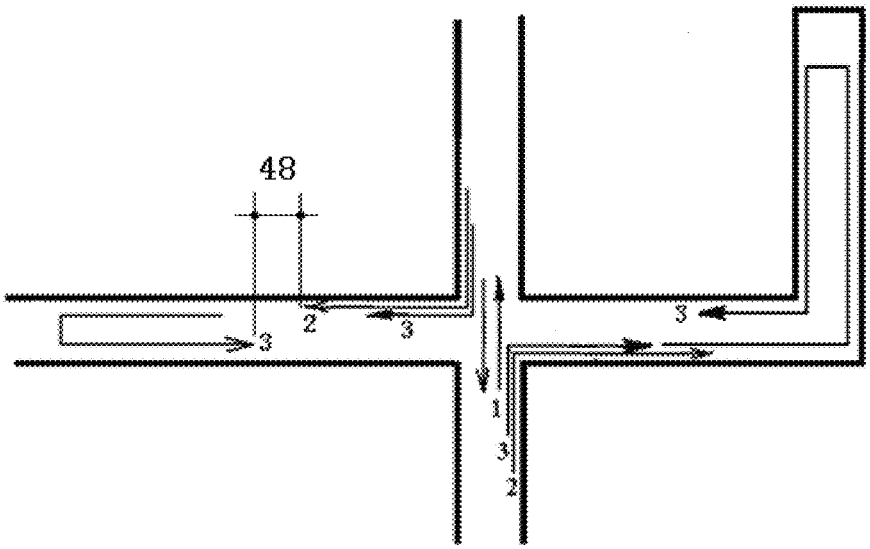

The full line is the flow line on the elevated road and the dotted line is the flow line in the tunnel FIG. 5 Diagram of Flow Line of Vehicle The full line is the flow line on the elevated road and the dotted line is the flow line in the tunnel FIG. 6 Plan of Motorway Tunnel FIG. 7 Part of intersection of the ground floor Plan of Crossroad Community Center FIG. 8 Plan of Exclusive Bikeway Interlayer FIG. 9 Plan of Motorway Elevated Road FIG. 10 I-I Section FIG. 11 II-II Section FIG. 12 Section FIG. 13 IV-IV Section FIG. 14 V-V Section FIG. 15 VI-VI Section FIG. 16 VII-VII Section FIG. 17 VIII-VIII Section FIG. 18 IX-IX Section FIG. 19 X-X Section FIG. 20 Left Turn Loop 1 South→Turning left to the north→West gradients are not in proportion and just for demonstration purpose FIG. 21 Left Turn Loop 2 North→Turning left to the south→East gradients are not in proportion and just for demonstration purpose FIG. 22 Left Turn Loop 3 West→Turning left to east→North gradients are not in proportion and just for demonstration purpose FIG. 23 Left Turn Loop 4 East→Turning left to the west→South gradients are not in proportion and just for demonstration purpose FIG. 24 Adaptation of Elevated Bridge Schematic diagram of Extension of flat section Schematic diagram of left turn Curve (Applying at small crossroads)

Figure 25:
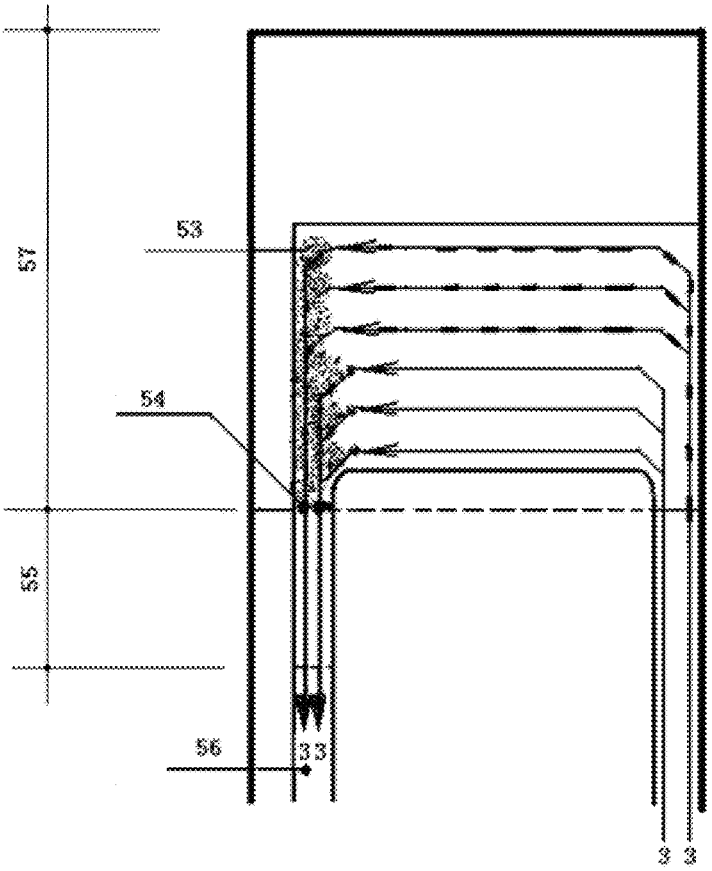
Figure 26:
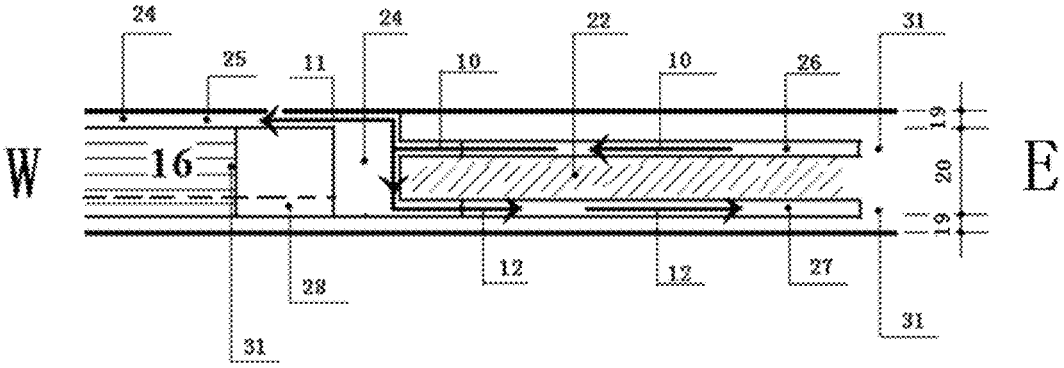
Figure 27:
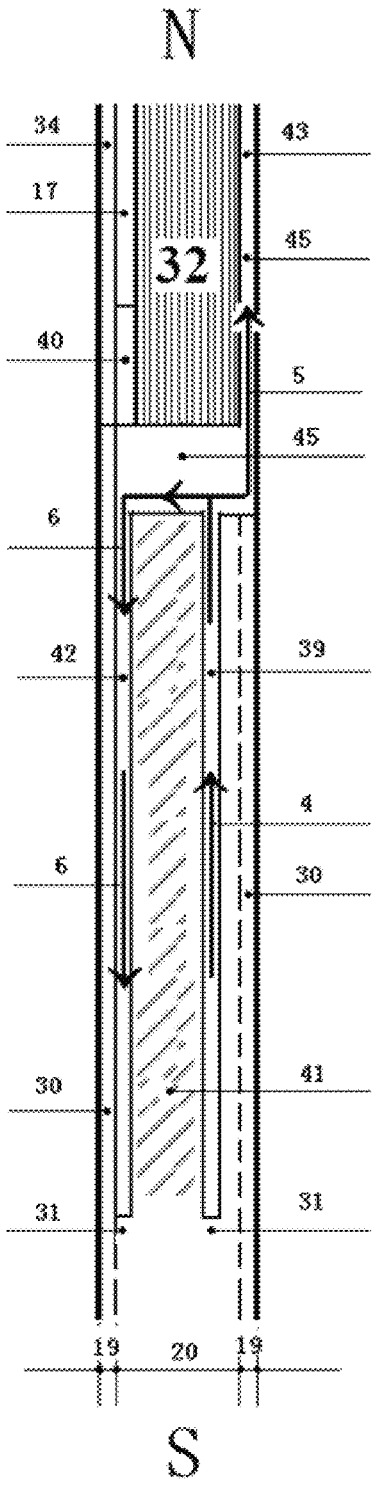

FIG. 25 Left turning lane lower vehicle speed guarantee the traffic flow ensure safety FIG. 26 One method of "adding a lane" Utilizing the space below returning ground floor ramp for vehicles turning left and traveling down to the ground in the elevated road layer, adding a lane to travel down to the tunnel;

FIG. 27 Another method of "adding a lane" Utilizing the space above returning ground floor ramp for vehicles turning left and traveling up to the ground in the tunnel layer, adding a lane to travel up to the elevated road.

IN THE FIGURES

Elevated road layer 100;
Interlayer 200;
Ground floor 300;
Tunnel layer 400.

1. Flow line Go straight on elevated road
2. Flow line Turning right on elevated road
3. Flow line Turning left on elevated road
4. Flow line Elevated road and exit lane
5. Flow line Elevated road and vehicle turning direction in the exit lane
6. Flow line Elevated road and vehicle turning around in the exit lane
7. Flow line Go straight in tunnel
8. Flow line Turning right in tunnel
9. Flow line Turning left in tunnel
10. Flow line Tunnel and exit lane
11. Flow line Tunnel and vehicle turning direction in the exit lane
12. Flow line Tunnel and vehicle turning around in the exit lane
13. Alternative sites of mobile communication base station
14. Symmetrical points of the central plane of the crossroad
15. Separation point for turning left and right
16. Main ramp of tunnel

17. Upward ramp for right-turn vehicles in the tunnel layer returning to the ground floor
18. Upward ramp for left-turn vehicles in the tunnel layer returning to the ground floor
19. The area of bikes
20. Motorway
21. The parking area beside the lanes of the tunnel layer
22. Area for the second round of exploitation horizontal plane bottom elevation of tunnel
23. Left-turn vehicle looping-back lane of the tunnel layer
24. Bottom elevation of tunnel
25. Flat horizontal section for vehicle turning directions in tunnel and exit lane bottom elevation of tunnel
Above which is the area of bikes
26. Lower ramp tunnel and exit lane for vehicle to drive to tunnel ahead of time upper ramp the ramp for vehicle turning left on elevated road and back to the ground
27. Tunnel and ramp for vehicle turning around in the exit lane and back to the ground
28. Ramp for vehicle turning right on elevated road and back to the ground
29. Ramp for vehicle turning left on elevated road and back to the ground
30. Bikeway on the ground
31. ±0.000
32. Main ramp of elevated road
33. Area under elevated road, of which the height is lower than the standard of use
34. Ramp of bikeway
35. Sidewalk
36. Crossroad vehicle free space level with the sidewalk
37. sets of stairs above the ramp of tunnel
38. Exclusive bikeway interlayer
39. Upper ramp elevated road and exit lane for vehicles driving to the elevated road ahead of time lower ramp the ramp for vehicles turning left in the tunnel and back to the ground
40. A section of lane on the ground beside the main ramp of elevated road
41. Area for the second round of exploitation horizontal plane top elevation of elevated road
42. Elevated road and ramp for vehicle to turn around in exit lane and back to the ground
43. Elevated road and flat horizontal section for vehicle turning direction in the exit lane top elevation of elevated road below which is the area of bikes
44. The parking area beside the lanes of the elevated road layer
45. Top elevation of elevated road
46. Left-turn vehicle looping back lane of elevated road layer
47. Elevation of bikeway interlayer
48. Length-extensible section
49. Area of the main ramp of elevated road
50. Area of the minor ramp of elevated road
51. Area of the main ramp of tunnel
52. Area of the minor ramp of tunnel
53. Buffer area
54. Concentrate the traffic flow and pass through fast
55. Tentatively set at 20 m of length level with the lane
56. Ramp to the ground
57. Dimension of the front end of horizontal long wings reserving sufficient land for more lanes in accordance with the circumstances
58. Upslope
59. Downslope
60. Horizontal right-turn lane of the extended area of intersection core
61. Straight-going lane on the horizontal Long wing
H. Tunnel
D. Ground
T. Elevated road
E. East
W. West
S. South
N. North

DETAILED DESCRIPTION OF EMBODIMENTS

The technical solutions of the embodiment will be described in a clearly and fully understandable way in connection with the drawings related to the embodiments of the present invention. It is obvious that the described embodiments are just a part but not all of the embodiments of the present invention. Based on the described embodiments herein, those skilled in the art can obtain other embodiment(s), without any inventive work, which should be within the scope of the present invention.

1. Annotations of figures

The figure is symmetrical. The symmetry point is the central point of the crossroad in (14) of FIG. 9.

The height, width and gradient can be determined according to the circumstances.

The area of parking lot or other items can be determined according to the circumstances.

Municipal pipelines can be well arranged.

The design can be altered in countries where drivers sit on the right.

The height scales in the figures are altered for the sake of clarity. The gradient is not exact.

2. Assumed parameters of the figures (can be altered according to the circumstances)

The two intersecting roads are all with five lanes in both directions.

The bottom elevation of the tunnel is −6.000 m.

The elevation of the ground road is ±0.000, the elevation of the space of the intersection is level with the sidewalk, indicated with bold lines;

The elevation of the bikeway interlayer is +4.000 m.

The top elevation of the elevated road is +8.000 m.

The gradient of the motorway ramp is 5% (can be altered according to the circumstances)

The gradient of the bikeway ramp is 2.5%.

The distance between the ends of the ramps of the elevated road, tunnel and bikeway at the crossroad and the outer edge of the core of the crossroad is 20 m.—as an example, the two intersectant roads are bidirectional 5 lanes, and the vehicle's road is 35 meters wide, and the total width of the road is 41 meters after the bikeway is added. The term "crossing core" refers to 41×41 square meters, and after each of the sides is expanded for 20 meters, the 41×41+41×20×4 square meters is named "Extended Area of the Intersection Core".

There is a flat section of 20 m on the ground between the two ramps of the left-turning lane. The length can be altered according to different separation distance of the crossroad.

3. The issue of road width. The ramp to the ground will take up the land of the motorway. It will increase pressure on the flow of vehicles drive into the crossroad.

Therefore a road with five or more lanes in both directions won't be faced with such problem. The "Add a Lane" could be employed if the traffic flow is unbalanced.

It is not recommended to employ the multifunctional and multi-story crossroad on roads with two lanes in both directions. The plan of the crossroad of a main road and a minor road is to prohibit vehicles from turning left for the second time, and to employ the "Add a Lane", as well as other measures, according to the circumstances.

On roads with three or four lanes in both directions, the prohibition of turning left for the second time, the "Add a Lane", and other measures can be employed if necessary.

Other modifications could be made according to the circumstances with the principle of saving space.

4. The solutions to inadequacy of road width

Circuitous Method. In the standard plan, the main ramps (16) or (32) and the minor ramps (29) or (18) are arranged in a line. In an altered plan, the main ramps and the minor ramps (29) or (18) are designed to form an angle, e.g., an angle of 90 degree. A left-turning vehicle loops in neighboring road and drives to the ground, then turns right to the main ramps (16) or (32) of dypass. (See FIG. 24).

Stretch Method. This method opens up the distance between the main ramps (16) or (32) and minor ramps (29) or (18). (See FIG. 48) The minor ramp is set between the first and the second crossroads. The disadvantage is that vehicles driving back to the ground have to go through a crossroad with traffic light in the neighboring crossroad.

Encroachment Method. To follow the standard plan except to alter the minor crossroad to an incomplete traffic crossroad.

Other modifications made by professionals.

5. The small radius of the loop for left-turning vehicle affects the traffic flow and lowers speeds. It may cause a potential safety hazard when the volume of traffic is saturated.

Solution: To take advantage of the large area of horizontal long wing and add lanes, lower speed, maintain traffic flow and ensure safety. The left-turning vehicle flow turns right into two lanes and lowers speed, then turns left for the first time to four or six lanes at the front end of the horizontal long wing and stops to queue up. After that it turns left for the second time to one lane or two lanes to pass through fast.

See FIG. 25

Sufficient land can be reserved in the front area of the horizontal long wing for adding lanes or parking vehicles.

Navigation indicators can be set on the cross-bars above road. And electronic polices can be placed to direct the traffic flow.

The road can be coated with material of high friction. To counteract some of the centrifugal force of vehicles turning round, the outer side of the direction turning lane can be specially built higher than the inner side.

6. Modifications and adaptations can be made at T-junctions and crossroads of more than two roads. Traffic lights can be set on the multi-functional floor. Modifications can be made in countries where drivers sit on the right.

7. The crossroad may be extended wider to take up the area above the sidewalk, to add a story upward or downward, or to connect the underground street.

8. The ramp can be a shortcoming of this invention and requires further studies.

The selection of gradient can be deeply researched.

The waterproof measures of the tunnel can be studied and improved.

Skid resistance research of ramps can be carried out in bitter cold cities.

9. The contradiction between the municipal pipelines underground and the crossroad can be an important issue. Experience can be drawn from the constructions of metros and tunnels. However, for this design, the pipelines can be moved away from the main roads; the underground space below the sidewalk and bikeway could be used to accommodate pipelines; the structural layers of tunnel and elevated road can be added to higher than 1.5 m to be threaded through by pipelines; and the heavy caliber rain pipes, sewage pipes, large-scale emergency sewage reservoirs and other major pipelines could be laid deeper than the tunnel. In summary, solutions can be carefully studied and made by related professionals.

10. The perfect implementation of the design needs a strong spirit of teamwork. One of the structural concepts is that the columns of the primary structure are placed to the side, and the steel-structured bikeway interlayer is suspended on the elevated road, in order to make a large space without or with few columns for the crossroad community center.

11. Considerations about bikes:

The choice could be made by cyclists themselves whether to ride bikes or mopeds.

The bike manufacturers will research and develop labor-saving and secure bikes to meet the requirements of the market if roads are rugged and to ensure safety when going up or down the slopes.

12. Other innovative technologies can be employed, for example, air quality physical cleaning and aeration techniques, sequestration of automobile exhaust, fence of liana, and spray cleaning. The matching techniques are still needed.

The invention claimed is:

1. A multi-story crossroad for intensive land use, characterized in that it has story segregation in the area of road junctions and nearby sections, and includes four layers: a first layer of elevated road layer above a second layer of interlayer, the interlayer being above a third layer of ground floor, the ground floor in turn being above a fourth tunnel layer;

wherein the elevated road layer is configured for vehicles traveling straight along a South-North direction when they need to pass straight; it is also configured for vehicles directly turning right and traveling down to the ground floor when they need to turn right; it is also configured for vehicles turning right first on one of two lateral horizontal long wings of the elevated road layer, then going straight, then turning around, traveling down to the ground floor and then entering the tunnel layer to complete left-turning when they need to turn left;

the interlayer is configured for bicycles exclusively, the exclusive bikeway interlayer is provided right above an Extended Area of an Intersection Core of the ground floor and right below an Extended Area of an Intersection Core of the Elevated Road layer; openings are made in a center of the exclusive bikeway interlayer, bike ramps are arranged on the exclusive bikeway interlayer in four directions to connect with the ground floor, and the exclusive bikeway interlayer is configured for allowing travelling and parking of bikes;

part of the ground floor is configured for a vehicle-free community center that includes: a higher part which is located under two main ramps of the elevated road layer; the Extended Area of the Intersection Core of the ground floor; and two sets of stairs oppositely arranged above two main ramps of the tunnel and not leading to any other layer;

the higher part, which is located under the two main ramps of the elevated road, and the Extended Area of the Intersection Core of the ground floor of the vehicle-free community center are level with a sidewalk, wherein people can freely walk between the vehicle-free community center and the sidewalk, and there is no access route to the community center for vehicles;

the tunnel layer is configured for vehicles traveling straight in an East-West direction perpendicular to the South-North direction, when they need to pass straight; it is also configured for vehicles directly turning right and traveling up and along the ground floor when they need to turn right; it is also configured for vehicles turning right first on a lateral horizontal long wing of the tunnel layer, then going straight, then turning around, traveling up to the ground floor, and then entering the elevated road layer to complete left-turning when they need to turn left;

the Extended Area of the Intersection Core of the ground floor comprises a central portion of an intersection of the ground floor and four 20-meter long roads, one on each side of the central portion of the intersection of the ground floor;

the Extended Area of the Intersection Core of the elevated road layer comprises a central portion of an intersection between the elevated road layer and four 20-meter long roads, one on each side of the central portion of the intersection of the elevated road layer.

2. The multi-story crossroad according to claim 1, wherein the elevated road layer includes: a straight bridge and an elevated platform comprising the two lateral horizontal long wings of the elevated road layer; the straight bridge lays in and extends along the South-North direction, and the two lateral horizontal long wings, together, lay in and extend in the East-West direction; the straight bridge and the two lateral horizontal long wings intersect;

wherein the straight bridge of the elevated road layer specifically includes the two main ramps of the elevated road layer, the Extended Area of the Intersection Core of the elevated road layer and horizontal right-turn lane;

each lateral horizontal long wing of the elevated platform of the elevated road layer comprises a parking area beside a motorway of the elevated road layer in the middle of the lateral horizontal long wing, a vehicle straight-going lane located on the right side of the lateral horizontal long wing, a left-turn vehicle looping-back lane of the elevated road layer at the end of the lateral horizontal long wing; the two main ramps of the elevated road layer comprising a first downward ramp and a second downward ramp; the first downward ramp configured for right-turn vehicles in the elevated road layer going to the ground floor, the said first downward ramp being located on the right side of the lateral horizontal long wing and connected downward to the ground floor, and a second downward ramp configured for left-turn vehicles in the elevated road layer going to the ground floor, the said second downward ramp being located on the left side of the lateral horizontal long wing connected downward to the ground floor;

in the elevated road layer:

a flow line of vehicles going straight in the elevated road layer is as follows: the two main ramps of the elevated road layer and the Extended Area of the Intersection Core of the elevated road layer constitute a continuous road for vehicles passing straight;

a flow line of vehicles turning right on the elevated road layer is as follows: the horizontal right-turn lane located in the Extended Area of the Intersection Core of the elevated road layer on the straight bridge, and first downward ramp for right-turn vehicles in the elevated road layer going to the ground floor, constitute a continuous road for vehicles turning right;

a flow line of vehicles turning left on the elevated road layer is as follows: the U-type successive connection of horizontal right-turn lane located in the Extended Area of the Intersection Core of the elevated road layer on the straight bridge, vehicle straight-going lane on the lateral horizontal long wing of the elevated layer, left-turn vehicle looping-back lane on the elevated road layer, and second downward ramp configured for left-turn vehicles in the elevated road layer going to the ground floor, constitutes a continuous road for vehicles turning left.

3. The multi-story crossroad according to claim 1, wherein the tunnel layer comprises an intersection of a straight tunnel with two lateral horizontal long wings of the tunnel layer, the straight tunnel extending along the East-West direction and the lateral horizontal long wings of the tunnel layer extending along the South-North direction;

wherein the straight tunnel specifically includes two-way main tunnel ramps extending along the East-West direction, an Extended Area of the Intersection Core of the tunnel layer, and a horizontal right-turn lane of the Extended area of the Intersection Core which is located at the right side of each main tunnel ramp;

each lateral horizontal long wing of the tunnel layer comprises a parking area in the middle of the lateral horizontal long wing of the tunnel layer, a vehicle straight-going lane located on the right side of the lateral horizontal long wing of the tunnel layer, a left-turn vehicle looping-back lane at the end of the lateral horizontal long wing of the tunnel layer, an upward ramp which is located on the right side of the lateral horizontal long wing of the tunnel layer for right-turn vehicles in the tunnel layer going to the ground floor, and a second upward ramp which is located on the left side of the lateral horizontal long wing of the tunnel layer for left-turn vehicles in the tunnel layer going to the ground floor;

in the tunnel layer:

a flow line of vehicles going straight on tunnel layer is as follows: two two-way tunnel main ramps and the Extended Area of the Intersection Core of the tunnel layer constitute a continuous road for vehicles passing straight;

a flow line of vehicles turning right on tunnel layer is as follows: the horizontal right-turn lane located in the Extended Area of the Intersection Core of the tunnel layer on the bottom of the straight tunnel, and upward ramp for right-turn vehicles in the tunnel layer going to the ground floor, constitute a continuous road for vehicles turning right;

a flow line of vehicles turning left on tunnel layer is as follows: a U-type successive connection of the horizontal right-turn lane located in the Extended Area of the Intersection Core of the tunnel layer at an end of the straight tunnel, vehicle straight-going lane on the lateral horizontal long wing of the tunnel layer, left-turn vehicle looping-back lane on the tunnel layer, and upward ramp for left-turn vehicles in the tunnel layer going to the ground floor, constitute a continuous road for vehicles turning left.

4. The multi-story crossroad according to claim 1, characterized in that a parking area beside a motorway of each lateral horizontal long wing of the elevated road layer is used for parking vehicles.

5. The multi-story crossroad according to claim 1, characterized in that a parking area beside a motorway of each lateral horizontal long wing of the tunnel layer is used for parking vehicles.

* * * * *